United States Patent [19]

Counts et al.

[11] Patent Number: 4,873,403

[45] Date of Patent: Oct. 10, 1989

[54] ON-OFF SWITCH SYSTEM FOR A PAIR OF CONDUCTORS

[75] Inventors: Richard Counts, Dallas; Rob Pritchett, Carrollton, both of Tex.

[73] Assignee: Prescolite, Inc., San Leandro, Calif.

[21] Appl. No.: 225,533

[22] Filed: Jul. 28, 1988

Related U.S. Application Data

[63] Continuation of Ser. No. 47,046, May 5, 1987.

[51] Int. Cl.[4] ..... H01H 9/12

[52] U.S. Cl. ..... 200/330; 200/335; 200/547; 307/115

[58] Field of Search ..... 200/330, 335, 305, DIG. 1, 200/547; 361/292; 307/115, 116, 109

[56] References Cited

U.S. PATENT DOCUMENTS

| | | | |
|---|---|---|---|
| 3,178,530 | 4/1965 | Lawson | 200/335 |
| 3,542,988 | 11/1970 | Baldasare | 200/305 |
| 3,816,686 | 6/1974 | Budd et al. | 200/330 |
| 4,672,229 | 6/1987 | Skarman et al. | 200/DIG. 1 |

*Primary Examiner*—Renee S. Luebke

*Attorney, Agent, or Firm*—Bielen & Peterson

[57] ABSTRACT

An ON-OFF switch system for use between first and second conductors utilizing a first plate having first and second sides. The second side of the face plate includes an appendage which contacts an arm passing through a second plate. First and second plates slidingly engage one another to operate the arm. The arm is further connected to one of a pair of electrical contact members and is movable to operate contacts of the electrical members.

8 Claims, 2 Drawing Sheets

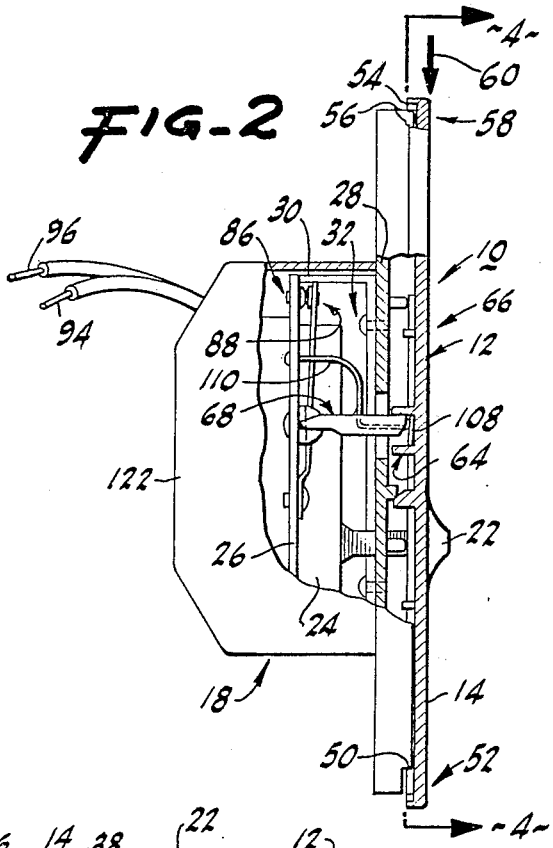
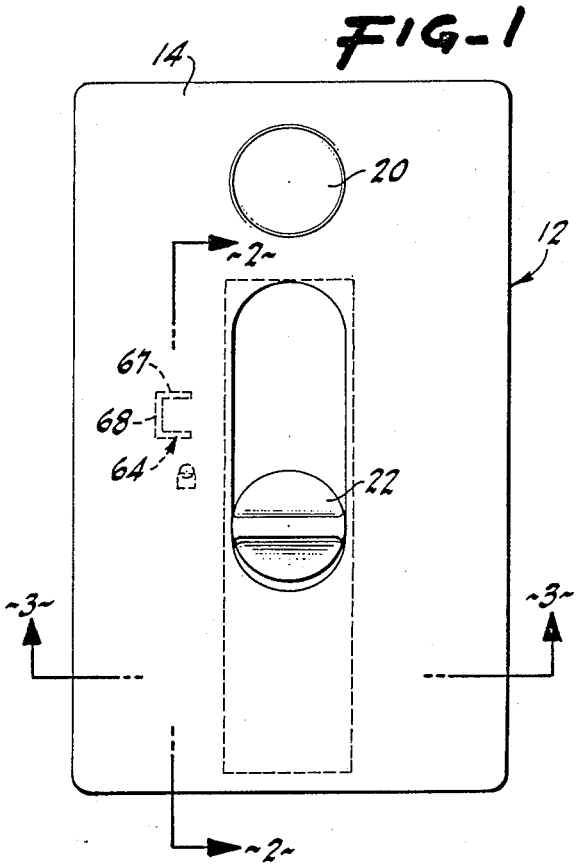
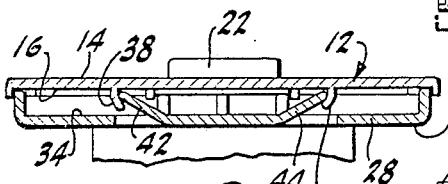
FIG-3
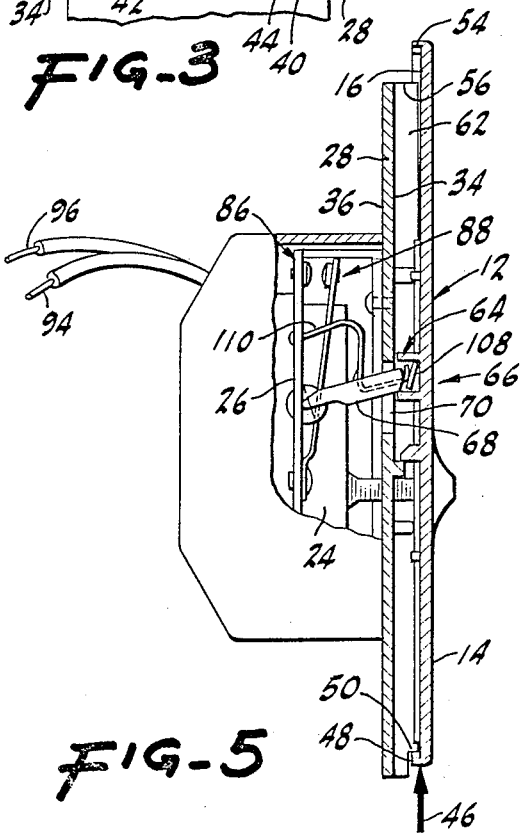
FIG-5
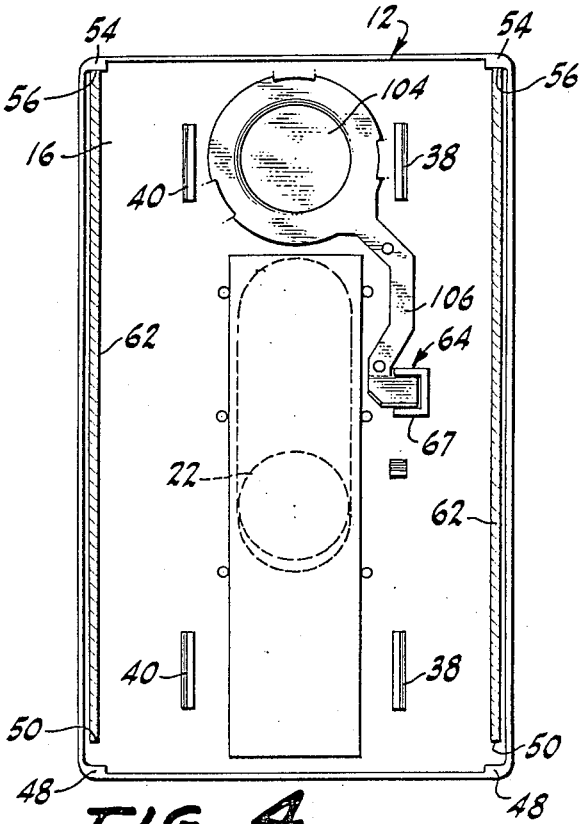
FIG-4

ON-OFF SWITCH SYSTEM FOR A PAIR OF CONDUCTORS

This is a continuation of application Ser. No. 047,046, filed May 5, 1987.

BACKGROUND OF THE INVENTION

The present invention concerns a switch system which is especially useful for a lighting switch having ON-OFF and dimmer capabilities.

Switches, such as the assembly disclosed in U.S. Pat. No. 4,455,546 to Roszel, teach a wall box mounted controller having separate ON-OFF and dimming capabilities. This combination is particularly useful in setting the lighting or other voltage level and returning to the same particular level following operation of the ON-OFF switch. The Roszel device employs a slider actuator which is separate from the face plate and heat sink. Although functional, the Roszel device creates spacing problems during installation due to a large depth dimension.

It is also known that prior lighting dimmer switches employed electronic ON-OFF switches. However, certain safety standards require that an ON-OFF switch, combined with a dimmer potentiometer, be of the air-gap type. Moreover, the use of an electronic ON-OFF switch is deemed to be a more convenient type of switch.

A switch system which permits the use of electronic and air-gap ON-OFF switches in combination with a dimmer potentiometer in a compact form would be a great advance in the voltage control field.

SUMMARY OF THE INVENTION

In accordance with the present invention an ON-OFF switch system is provided which is particularly useful as a lighting controller.

The ON-OFF switch system of the present invention utilizes a first plate having a first side and a second side. The second side of the first plate possesses an appendage. A second plate is also employed and includes a first and second side. The second plate is further provided with an opening through the same. The first and second plates slidingly engage one another such that the second side of the first plate is in facing relationship with the first side of the second plate. Such sliding engagement may include a stop mechanism to limit the sliding travel between the plates.

The system is also defined as including first and second electrical contact members that are electrically linked to first and second conductors which are to be switched. The first electrical contact member is connected to a support element. The support element is connected to the second side of the second plate. The second electrical contact member is movable relative to the first electrical contact member in this regard.

An arm is also included for contacting the movable electrical contact member. The arm extends through the opening in the second plate and into engagement with the appendage of the first plate for movement with the sliding of the first and second plates. Such movement of the arm effects movement of the second electrical contact member relative to the first electrical contact member, thus providing an ON-OFF switching of electrical current between the first and second conductors. The arm may rotate relative to the support element and include a recess having an edge for engagement of the second electrical contact member. The movable second electrical contact member may further rest within the recess of the arm. Moreover, the support element may include means for guiding the rotational movement of the arm with the second movable electrical contact member lying within the recess.

The first plate may also include a third conductor extending to the vicinity of the appendage on the second side of the first plate. Likewise, the arm may include a fourth conductor which extends between the support element and through the second plate opening to the vicinity of the appendage of the first plate. Contact between the third and fourth conductors at the appendage is maintained during movement of the arm. The appendage may further include means for guiding the movements of the arm. The third conductor may also terminate in a spring. The fourth conductor would be positioned to exert a force of the spring during movement of the arm.

Means may also be employed for generating a signal on the first side of the first plate and passing that signal to the third conductor on the second side of the first plate. Such signal may be employed to electronically operate an ON-OFF switch. In most cases, the electronic ON-OFF switch would not operate unless the first and second contact members were electrically connected.

It may be apparent that a novel and useful ON-OFF switch system is provided.

It is an object of the present invention to provide an ON-OFF switch system which is compact and efficiently permits the use of an air-gap ON-OFF switch as well as an electronic ON-OFF switch.

It is another object of the present invention to provide an ON-OFF switch system which is compatible with a slide dimmer operator.

Another object of the present invention is to provide an ON-OFF switch system which employes an air-gap switch operated by a moving face plate which is easily manipulated.

A further object of the present invention is to provide an ON-OFF switch system which utilizes an arm in conjunction with an air-gap switch, the arm also serving to carry a signal between a pair of conductors.

The invention possesses other objects and advantages especially as concerns particular characteristics and features thereof which will become apparent as the specification continues.

BRIEF DESCRIPTION OF THE DRAWINGS

FIG. 1 is a front elevational view of the switch system of the present invention.

FIG. 2 is a sectional view taken along line 2—2 of FIG. 1.

FIG. 3 is a sectional view taken along line 3—3 of FIG. 1.

FIG. 4 is a sectional view taken along line 4—4 of FIG. 2.

FIG. 5 is a side view having a portion in section showing the air-gap switch in an open configuration.

Figure 6:
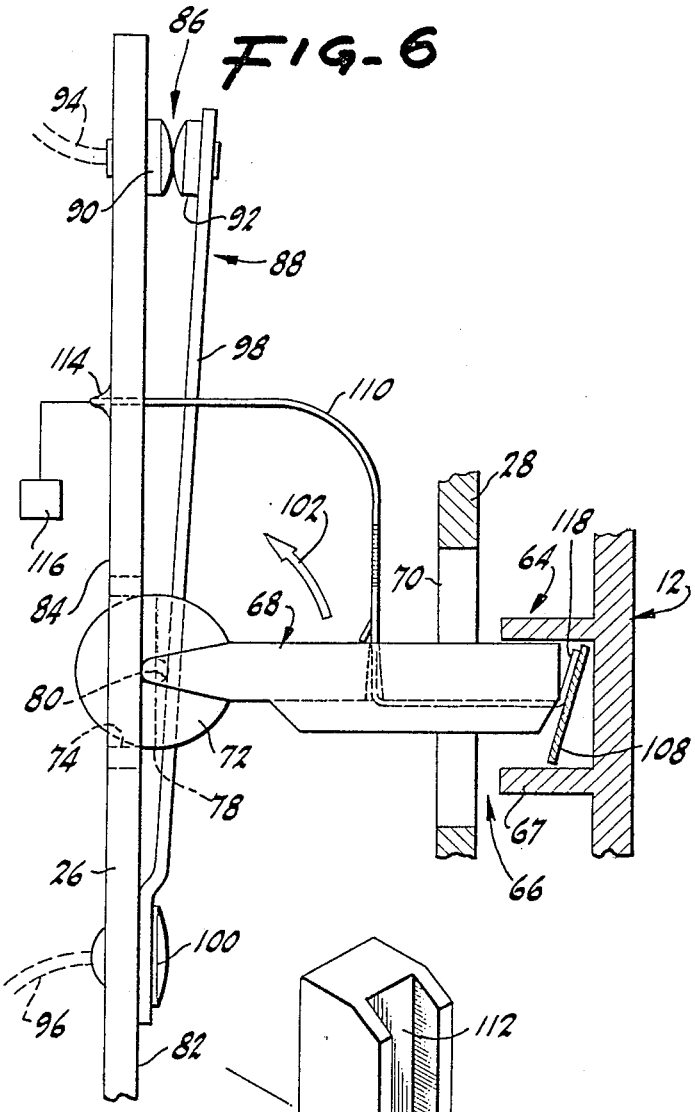
FIG. 6 is an enlarged elevational view of the air-gap switch mechanism depicted in FIGS. 2 and 5.
Figure 7:
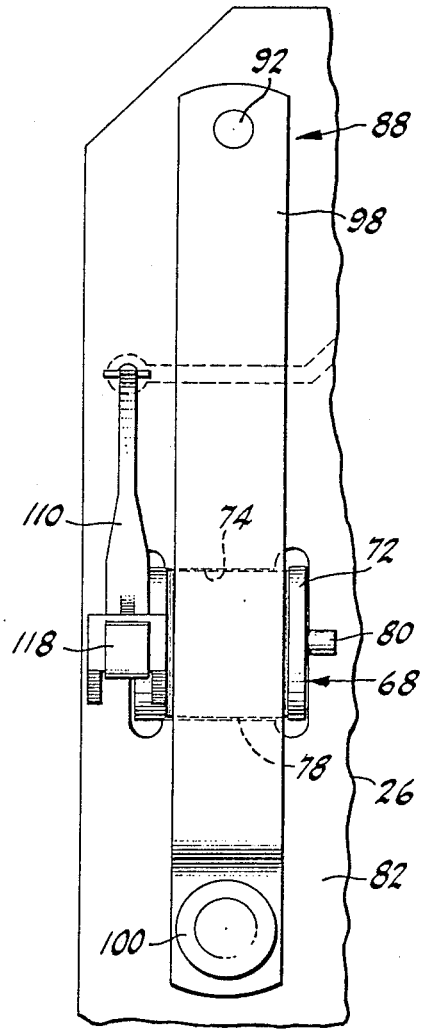
FIG. 7 is a right side view of an air-gap switch depicted in FIG. 6.
Figure 8:
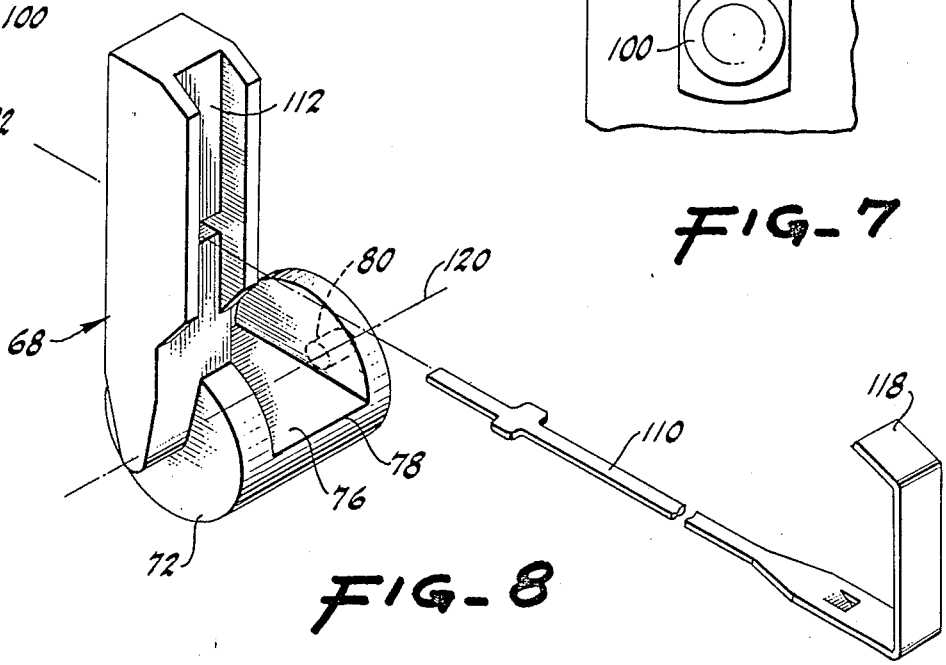
FIG. 8 is a perspective view of the actuating arm and a conductor employed in the present system.

For a better understanding of the invention reference is made to the following detailed description of the preferred embodiments thereof which should be referenced to the hereinabove described drawings.

DETAILED DESCRIPTION OF THE PREFERRED EMBODIMENTS

Various aspects of the present invention will evolve from the following detailed description of the preferred embodiments of the invention which should be taken in conjunction with the prior described drawings.

The system as a whole is depicted in the drawings by reference character 10. Switch system 10 includes as one of its elements a first plate 12, FIGS. 1–4, which includes a first side 14 and a second side 16. First plate 12 may be constructed of electrically insulative material. First side 14 of plate 12 would serve as the face of wall box voltage controller 18. Touch button 20 and slide operator 22 are also accessible on first side 14 of plate 12. Slide operator 22 would be electrically connected to potentiometer 24 which is connected to circuit board 26. Circuit board 26 would also include electronic circuitry used to control voltages such as is required to dim lighting fixtures. Circuit board 26 fixes to second plate 28 by the use of bracket 30 and fastening means 32.

Second plate 28 includes a first side 34 and a second side 36. First side 34 of second plate 28 is in facing relationship with second side 16 of first plate 12. With reference to FIG. 3, it may be seen that second side 16 includes a pair of channels 38 and which capture wings 42 and 44 extending from first side 34 of plate 28. First and second plates 12 and 28 slidingly engage one another between wings 42 and 44 and the inside surface of channels 38 and 40. With reference to FIG. 5 it may be apparent that directional arrow 46 indicates a slide motion between plates 12 and 28. Lip 48 of first plate 12 contacts notch 50 of second plate 28 which serves as stop means 52 in the upward direction, FIG. 5. Lip 54 of first plate 12 engages the edge 56 of second plate 28 to serve as stop means 58 in the downward direction according to directional arrow 60. It should be noted that second plate 28 may be constructed of thermally conductive material, such as metal, to serve as a heat sink to electrical components found on surface 36 thereof. Heat passing through second plate 28 directly enters chimney or convection/chamber 62 and is vented from controller 18 by convection.

First plate 12 is formed with an appendage 64 which extends into chimney or convection chamber 62. Walls 67 of appendage 64 extend outwardly from second side 16 of first plate 12 in a U-shaped cross-sectional configuration. Appendage 64 serves as a cradle or means 66 for guiding movement of arm 68. Arm 68 is constructed of electrically non-conductive material such as plastic. Arm 68 extends through openings 70 of plate 28 and terminates in a cylindrical end portion 72. Circuit board 26 provides a recess 74 which confines cylindrical portion 72 thereat. Cylindrical portion 72 includes a slot 76 having an edge 78. Boss 80 rides on surface 82 of circuit board 26 and prevents cylindrical portion 72 from moving through recess toward surface 84 of circuit board 26.

System 10 also comprises first and second electrical contact members 86 and 88 which include contacts 90 and 92, respectively. First contact 90 electrically connects to first conductor 94 while contact 92 electrically connects to second conductor 96, shown schematically on FIG. 6. Contact 92 is fixed to conducting finger 98 which is, in turn, fixed at one end to insulative circuit board 26 by conductive rivet 100. As depicted in FIGS. 2 and 6, contacts 90 and 92 are closed. In this regard, contact 90 is fixed to circuit board 26 which serves as a support element therefor. Electrical contact member 88 is movable with the rotation of arm 68 according to directional arrow 102, which will be more fully described hereinafter. It should be noted, FIG. 5 depicts contacts 90 and 92 in an open position.

Returning to FIG. 1 it may be observed that touch button 20 lies opposite a conductive first plate 104 on side 16 of plate 12, FIG. 4. Plate 104 is electrically linked to conductor 106 which terminates in a leaf spring 108 within the confines of appendage 64. Touch button 20 may be formed of insulative material and is capable of generating a signal with plate 104 when an AC potential is applied to conductor 106. Conductor 110 attaches to circuit board 26 and extends into a channel 112 on arm 68. Terminal 114 on circuit board 26 would connect to low voltage AC potential 116, shown schematically in FIG. 6. Conductor 110 includes an angulated end portion 118 which contacts leaf spring 108 of conductor 106. It should be noted that such electrical contact between conductors 110 and 106 is maintained with movement of arm 68 as depicted in FIGS. 2 and 3. It should also be stated that conductor 110 is made of a flexible metallic material, not necessarily possessing a mechanical memory. On the other hand, finger 98 possesses a spring bias toward the normally closed position of contacts 90 and 92, depicted in FIG. 6.

In operation, a high voltage electrical potential is applied to conductor or wire 94 and travels to contact 90. Plate 12 in the position shown in FIG. 2 would permit transfer of electrical current from contact 90 to contact 92, along finger 98, to contact 100, and to conductor 96. Typically, line voltage is applied to conductor 94 in this manner. Moving plate 12 according to directional arrow 46, FIG. 5, will cause arm 68 to rotate according to directional arrow 102. Such rotation occurs approximately about the axis 120 of boss 80. During such rotation, arm 68 is confined by recess 74 of circuit board 26, by the mechanical contact of boss with surface 82 of circuit board 26, and by the contact between finger 98 and edge 76 of slot 78 within cylindrical portion 72 of arm 68. Conductor 110 and conductor 106 maintain electrical contact between angulated end portion 118 and leaf spring 108, respectively, during such rotation of arm 68. Thus, if a user's finger touches button 20, a capacitive coupling occurs which is maintained through conductors 106 and 110. Such a capacitive coupling or signal may be used in an electronic ON-OFF switch within wall box controller 18 or for other switching functions. Of course, contacts 90 and 92 being in an open configuration, FIG. 5, would prevent the capacitive coupling from reaching terminal 114, in the normal situation. Controller 18 may be constructed with a back box 122 which permits mounting of controller 18 in a standard electrical wall box. Slider 22 may operate potentiometer 24 independently of the ON-OFF switching operation initiated by push button 20.

While the foregoing embodiments of the invention have been set forth in considerable detail for the purpose of making a complete disclosure of the invention, it may be apparent to those of skill in the art that numerous changes may be made in such detail without departing from the spirit of the invention.

What is claimed is:

1. An ON-OFF switch system comprising:

a. first and second electrical conduits mechanically connected to a support element, said support element having an electrical terminal distinct from said first and second electrical conduits;

b. a first plate, said first plate including a first side and a second side, said second side of said first plate including an appendage;

c. a second plate including a first side and a second side and further including an opening therethrough;

d. means for linearly sliding said first plate relative to said second plate with said second side of said first plate being removably maintained in facing relationship with said first side of said second plate;

e. first and second electrical contact members for electrical linkage to said first and second electrical conduits, said first electrical contact member being mechanically connected to said support element, said support element being mechanically connected to said second plate, said second electrical contact member being movable relative to said first electrical contact member;

f. an arm contacting said movable second electrical contact member, said arm extending through said opening in said second plate and into engagement with said appendage of said first plate, for movement with said linearly sliding first plate, said movement of said arm effecting movement of said movable second electrical contact member relative to said first electrical contact member to effect electrical switching therebetween; and g. a first electrical conductor extending to said appendage and being supported thereat, said arm including a second electrical conductor mounted thereto and electrically connected to said terminal of said support element, said second conductor electrically contacting said first conductor, said movement of said arm with said linear sliding of said first plate moving said first and second conductors relative to one another while maintaining said electrical contact between said first and second electrical conductors.

2. The switch system of claim 1 which additionally comprises stop means for limiting said sliding between said first plate and second plate.

3. The switch system of claim 1 in which said arm rotates relative to the support element and said arm further includes a recess having an edge, said edge engaging said movable second electrical contact member during movement of said arm.

4. The switch system of claim 3 in which said movable second electrical contact member rests within said recess.

5. The switch system of claim 4 in which the support element includes means for guiding said rotational movement of said arm.

6. The system of claim 1 in which said appendage further comprises means for guiding said movement of said arm.

7. The system of claim 6 in which said first electrical conductor terminates in a spring, said second electrical conductor being positioned to exert force on said spring during movement of said arm.

8. The system of claim 7 which additionally comprises means for passing a signal from said first side of said first plate to said first electrical conductor, said sliding movement of said first plate permitting said signal to pass to said second electrical conductor concomitantly with said movement of said second electrical contact member.

* * * * *